US008708187B2

(12) United States Patent
Stern

(10) Patent No.: US 8,708,187 B2
(45) Date of Patent: Apr. 29, 2014

(54) CONTAINER WITH AN ANNULAR RIDGE LOCKING FEATURE

(76) Inventor: Paule Stern, San Diego, CA (US)

( * ) Notice: Subject to any disclaimer, the term of this patent is extended or adjusted under 35 U.S.C. 154(b) by 823 days.

(21) Appl. No.: 12/243,842

(22) Filed: Oct. 1, 2008

(65) Prior Publication Data

US 2009/0139997 A1 Jun. 4, 2009

Related U.S. Application Data

(60) Provisional application No. 60/976,665, filed on Oct. 1, 2007.

(51) Int. Cl.
*B65D 83/00* (2006.01)

(52) U.S. Cl.
USPC ..... 220/711; 220/658; 220/717; 215/387

(58) Field of Classification Search
USPC ..... 220/711, 717, 712, 658, 789; 215/387, 215/355; 229/404, 906.1
See application file for complete search history.

(56) References Cited

U.S. PATENT DOCUMENTS

| | | | | | |
|---|---|---|---|---|---|
| 2,599,919 | A * | 6/1952 | Hucknall | 220/710 |
| 3,057,537 | A * | 10/1962 | Pollick | 229/404 |
| 3,458,079 | A * | 7/1969 | Gasbarra | 220/787 |
| 3,722,784 | A * | 3/1973 | Harper | 229/404 |
| 4,607,755 | A * | 8/1986 | Andreozzi | 224/482 |
| 4,756,440 | A * | 7/1988 | Gartner | 220/711 |
| 5,205,473 | A * | 4/1993 | Coffin, Sr. | 229/403 |
| 5,423,476 | A * | 6/1995 | Ferrer | 229/404 |
| 5,645,191 | A * | 7/1997 | Neville | 220/717 |
| 5,820,016 | A * | 10/1998 | Stropkay | 229/403 |
| D547,617 | S | 7/2007 | Jones et al. | |
| 7,299,955 | B2 | 11/2007 | Pelkey et al. | |
| 7,416,093 | B2 | 8/2008 | Lin et al. | |
| 7,475,792 | B2 | 1/2009 | Hansen | |
| 2003/0226882 | A1 * | 12/2003 | Porchia et al. | 229/403 |
| 2004/0124196 | A1 * | 7/2004 | Ziegler | 220/288 |
| 2008/0128320 | A1 | 6/2008 | Woersdoerfer et al. | |
| 2008/0128417 | A1 | 6/2008 | Smith et al. | |
| 2008/0156802 | A1 | 7/2008 | Yauk et al. | |
| 2008/0185403 | A1 | 8/2008 | Goetz et al. | |
| 2008/0223883 | A1 | 9/2008 | Pelkey et al. | |
| 2009/0026213 | A1 | 1/2009 | McCarthy | |
| 2009/0026219 | A1 | 1/2009 | Bal | |

* cited by examiner

*Primary Examiner* — Steven A. Reynolds
*Assistant Examiner* — Javier A Pagan
(74) *Attorney, Agent, or Firm* — Lewis Kohn & Fitzwilliam LLP; Timothy W. Fitzwilliam

(57) ABSTRACT

A container having a cup and a lid, which in turn includes locking features, wherein the lid engages in a secure relation to the cup, is disclosed. In other embodiments, the invention is directed to a container having a lid that fits over an open end of a cup and a lid that fits inversely and inside the open end of a cup. The lid of the invention comprises at least one protruding annular ridge, allowing for secure placement on the cup when the cup is in motion. The lid fits in a complementary (positive/negative) relation to the protruding ridge(s) on the cup. This container is designed for the purpose of being in motion: while walking, driving, and all aspects of travel and carrying. Additional embodiments include novel spout designs for the cup portion and lid portion.

9 Claims, 5 Drawing Sheets

CONTAINER WITH AN ANNULAR RIDGE LOCKING FEATURE

PRIORITY CLAIM

This patent application contains subject matter claiming benefit of the priority date of U.S. Provisional Patent Application Ser. No. 60/976,665 filed on Oct. 1, 2007, accordingly, the entire contents of this provisional patent application is hereby expressly incorporated by reference.

BACKGROUND OF THE INVENTION

1. Field of the Invention

The present invention relates to containers with lids and locking features, such that the relation of the lid to vessel is sufficiently secure to prevent liquid from spilling out. The present invention also relates to containers comprising a thermally insulating material that protects the consumer holding the container from the heat of its contents.

2. Description of the Prior Art

With the rise in popularity of coffee, espresso drinks, and other hot beverages, consumers have been inconvenienced by poorly designed to-go cups and lids. Beverages frequently splash out of the lid holes from which consumers sip. To-go lids often are not secure enough to remain in place over the cup, resulting in spillage and forcing the consumer to carry the cup solely by its sidewalls.

Many to-go cups have lids that are moderately secured when sitting on a table, or when relatively stationary. Few however, manage to remain engaged and prevent liquid from spilling or leaking when the container is deformed, tipped over, being carried, or traveling in a car. Thus, there remains a need for a container that can hold liquid, with a lid designed to fit in secure relation to the cup to prevent the lid's accidental removal or spillage. It may also be more convenient for a consumer to have an option to safely pick up and carry a covered to-go cup by the lid or sidewalls.

Still further, to-go cups are often made of thin material that may be only marginally thermally insulated, making a cup with a hot beverage inside too hot to hold comfortably. The typical remedy is to slide a Java-Jacket® or other thermally insulating sleeve on to the cup. However, this a potentially environmentally wasteful solution and the sleeve requires an additional part or additional method step. Hence, there remains a need for a to-go cup with protective material in place such that the consumer's hands are always protected when holding the cup.

BRIEF SUMMARY OF THE INVENTION

The present invention specifically addresses and alleviates the above mentioned deficiencies, more specifically, the present invention, in a first aspect is directed to a container comprising a cup and a lid, which in turn comprise locking features, wherein the lid engages in a secure relation to the cup. The present invention also provides for embodiments having a lid that fits over an open end of a cup and a lid that fits inversely and inside the open end of a cup. The lid of the invention comprises at least one protruding annular ridge, allowing for secure placement on the cup, when the cup is in motion. The lid will fit in a complementary (positive/negative) relation to the protruding ridge(s) on the cup. This container is designed for the purpose of remaining secure while in motion, such as while walking, driving, and all aspects of travel and carrying.

This perfectly designed cup and lid will have a more ergonomic drinking station (spout) that will prevent dripping from the side of the mouth or over rim of the lid. The spout may also have a tapered distal end that restricts and directs the flow of fluid, preventing spills. That is, the spout will protrude outwardly from a proximal end and taper relatively to a distal end (or lip). The spout can be shaped to fit a human mouth to further prevent the risk of spilling or splashing while drinking. Additionally, the container can be made from any material such as, but not limited to, metal, paper, plastic, Styrofoam® or a combination thereof.

In another aspect, the invention is characterized as a container comprising: a vessel having an open top with a beaded rim and a closed bottom, wherein the vessel is capable of receiving and containing liquid; and a removable lid having a circumscribing lid brim, wherein the container has at least one locking feature comprising at least one outwardly protruding annular ridge formed from an upper side wall of the vessel and in combination with the lid, further wherein when the container is closed, the vessel and lid fit in a locking relationship.

Further, the invention is characterized wherein the lid fits over and covers the open top of the vessel, further wherein the lid comprises at least one inwardly protruding annular ridge. Additionally, the lid comprises at least two inwardly protruding annular ridges. Still further, the vessel comprises a spout formed from the upper side wall and rim, and extends outward from the vessel.

Also, the invention is further characterized wherein the lid comprises an opening to accommodate a spout such that when the container is closed, the lid opening allows the spout to fit through and the spout is accessible to a user. Yet further, the lid comprises a raised element, forming a hollow channel from the spout and the lid. Still further, the vessel comprises a spout formed from the upper side wall and rim, and extends outward from the vessel. Additionally, the lid comprises an opening to accommodate a spout, such that when the container is closed, the lid opening allows the spout to fit through and the spout is accessible to a user.

Preferred embodiments may be further characterized wherein the lid comprises a raised element, forming a hollow spout. Additionally, the vessel comprises a spout forming from the upper side wall extending outward from the vessel.

In another aspect, the invention is directed to a container comprising: a vessel having an open top with a beaded rim and a closed bottom, wherein the vessel is capable of receiving and containing liquid; a removable lid; and at least one locking feature comprising at least one outwardly protruding annular ridge formed from an upper side wall of the vessel and in combination with the lid, wherein the lid has at least one inwardly protruding annular rim, wherein the lid fits over and covers the open top of the vessel, and further wherein the lid has a spout rising over the rim of the vessel.

In another aspect, the invention is directed to a container comprising: a vessel has an open top with a beaded rim and a closed bottom, wherein the vessel is capable of receiving and containing liquid; a removable lid; at least one locking feature comprising at least one outwardly protruding annular ridge formed from an upper side wall of the vessel and in combination with the lid, wherein the lid has at least one outwardly protruding annular rim, wherein the lid fits inversely and above a sealing part of the lid, and inside the open top of the vessel, and further wherein the lid has a spout rising over the rim of the vessel.

While the apparatus and method has or will be described for the sake of grammatical fluidity with functional explanations, it is to be expressly understood that the claims, unless expressly formulated under 35 USC 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112, or similar applicable law. The invention can be better visualized by turning now to the following drawings wherein like elements are referenced by like numerals.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DETAILED DESCRIPTION OF THE PREFERRED EMBODIMENTS

In the following detailed description, reference is made to the accompanying drawings, which form a part hereof, and in which is shown by way of illustration specific embodiments in which the invention can be practiced. These embodiments are described in sufficient detail to enable those of ordinary skill in the art to practice the invention. It is understood by these same artisans that other embodiments can be utilized and that structural changes can be made without departing from the spirit and scope of the current invention. Thus, the following detailed description is not meant to limit the breadth of the invention, which is defined by the appended claims.

Figure 1A:
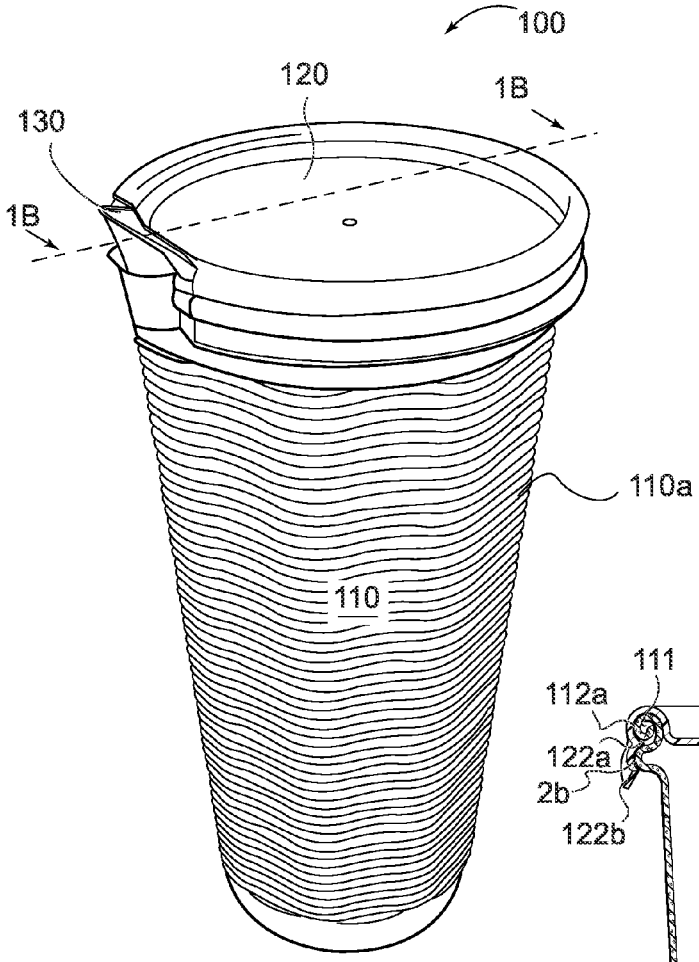
FIG. 1A is a perspective illustration of a first preferred embodiment of the present invention.
Figure 1B:
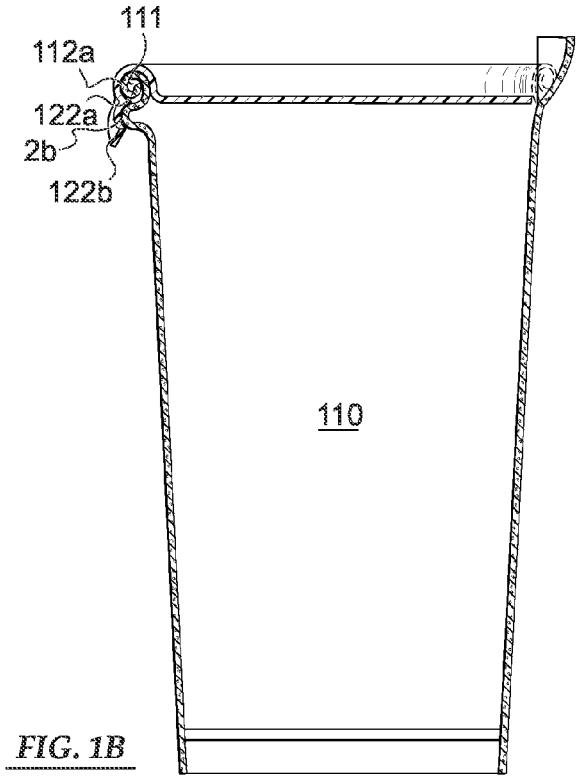
FIG. 1B is a sectional illustration as viewed along lines 1B of FIG. 1A.

With reference to FIG. 1A, the present invention may be initially characterized as a container 100 comprising a cup/vessel 110 having an open top with a beaded rim 111 and a removable lid 120. The container 100 can be used to hold a liquid beverage for ease of drinking and transport in a consumer's hand or in a cup holder. The container 100 may have a variety of lengths, widths, or depths. Referring to FIG. 1B, the container 100 also has a locking feature, comprising at least one outwardly protruding annular ridge 112*a*, 112*b* formed from the upper side wall of the vessel 110 and in combination with said lid 120. The lid 120 in a preferred embodiment is defined by a circumscribing brim, which in turn comprises protruding ridges 122*a*, 122*b*. The locking feature is engaged with the lid 120 and cup 110 fitting together in a tight locking relationship. With reference to FIGS. 3A, 3B, 4A, and 4C, some embodiments 300, 400 of the invention are characterized wherein the lid 320, 420 has a spout 330, 430 rising from a middle of the lid, having a fluid directing channel 340, 440 extending upwardly and outwardly, over the rim of the cup 300, 400. The spout 330, 430 of this embodiment is shaped to fit a human mouth, such that a lower lip is flush with the bottom of the spout, preventing spillage from the spout or the mouth.

In some embodiments 100, 300 the lid 120, 320 fits over the open top of the cup 110, 310. In this embodiment, the locking feature comprises at least one inwardly protruding annular ridge 122*a*, 122*b*, 322*a*, 322*b*, 322*c*, on the brim of the lid 120, 320. The locking feature is engaged when the lid is placed over the open top of the cup and the inwardly protruding ridge fits snugly between the beaded rim 111, 311 and an outwardly protruding ridge 112*a*, 112*b*, 312*a*, 312*b* of the cup 110, 310. Importantly, the fit of the locking features should be sufficiently snug that a consumer can pick up entire the container by the lid.

With reference to FIGS. 2A, 2B, 4A, and 4B, alternative embodiments 200, 400 are characterized wherein the lid of the container fits inversely, inside of the open top of the cup. The lid brim comprises at least one outwardly protruding annular ridge 222*a*, 222*b*, 222*c*, 422*a*, 422*b*, 422*c*. More specifically, the lid comprises a first annular ridge 222*a*, 422*a*, a second annular ridge 222*b*, 422*b*, and a lower most annular ridge 222*c*, 422*c*, wherein the second annular ridge is situated above the lower most annular ridge 222*c*, 422*c*, and below the first annular ridge 222*a*, 422*a*. The locking feature is engaged when the lid ridges fit in a complementary (positive/negative) locking relationship with the inwardly protruding ridges 212*a*, 212*b*, 212*c*, 412*a*, 412*b*, 412*c* of the cup 210, 410.

In alternative embodiments 100, 200 the cup 110, 210 has a sipping feature formed from the upper side of the wall and rim in the form of a pouring or sipping spout 130, 230. The spout extends outward and up from the cup rim and is designed to fit into a human mouth. Further, the spout may be shaped fit a human mouth, such that the lower lip is flush with the underside of the spout, preventing spillage from the spout or the mouth. In one embodiment 100, the lid 120 has a complementary opening 123 fitting snugly around the spout 130. The lid opening 123 is shaped to complement the underside of the spout 130, to achieve the snug fit. With this complementary fit, the spout 130 is accessible to the consumer (for sipping) while the lid 120 prevents the beverage from leaking or spilling from the cup 110 by engaging the locking features described above.

Figure 1C:
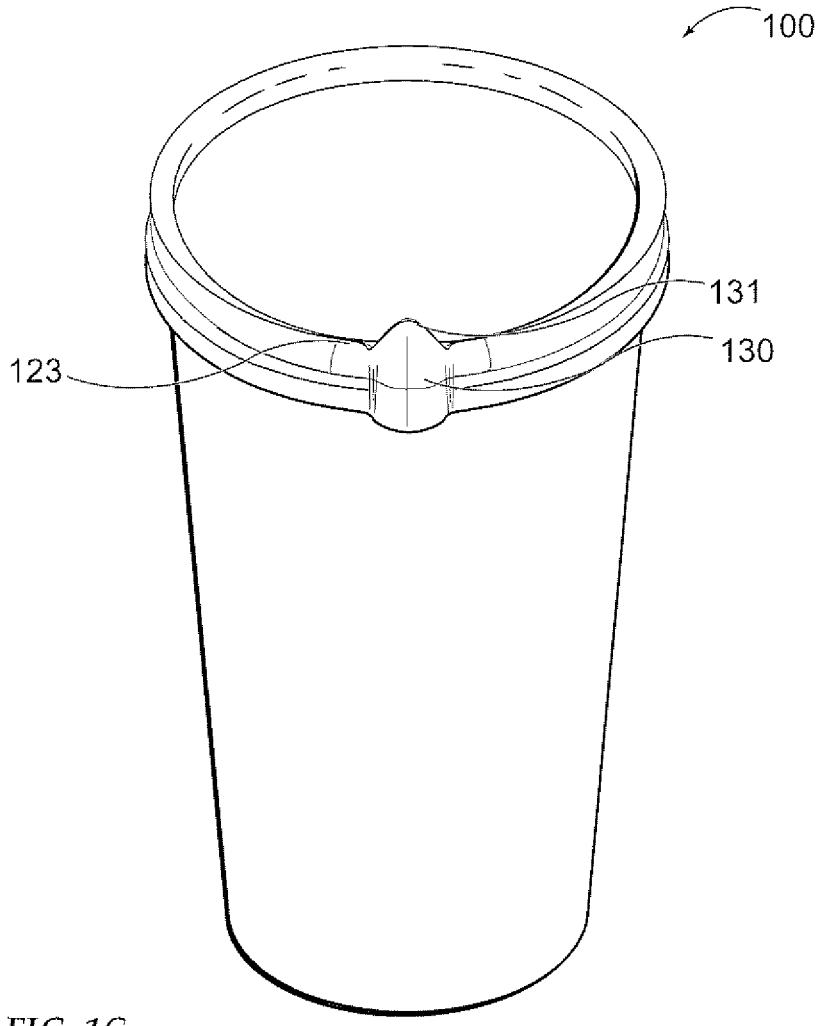
FIG. 1C is a perspective illustration of the first preferred embodiment specifically showing a front portion of a spout according to the embodiment.
Figure 2A:
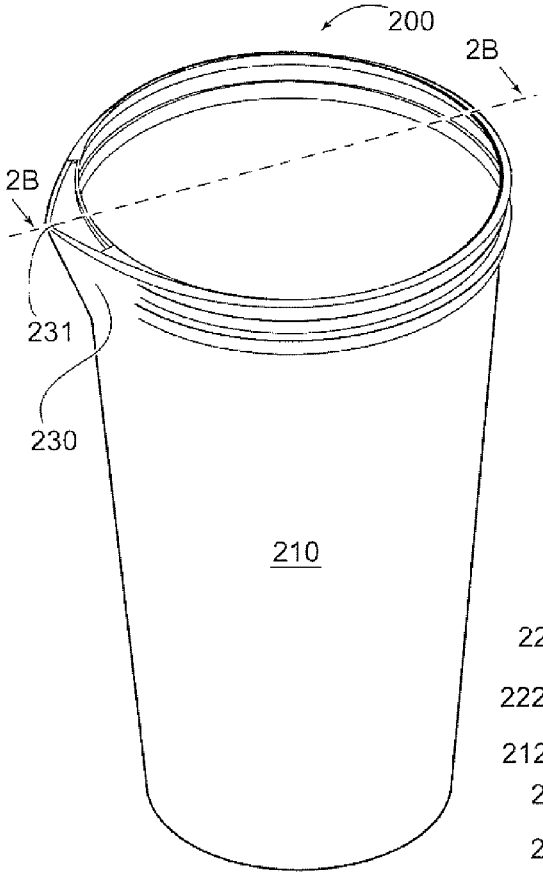
FIG. 2A is a perspective illustration of a second preferred embodiment of the present invention.
Figure 2B:
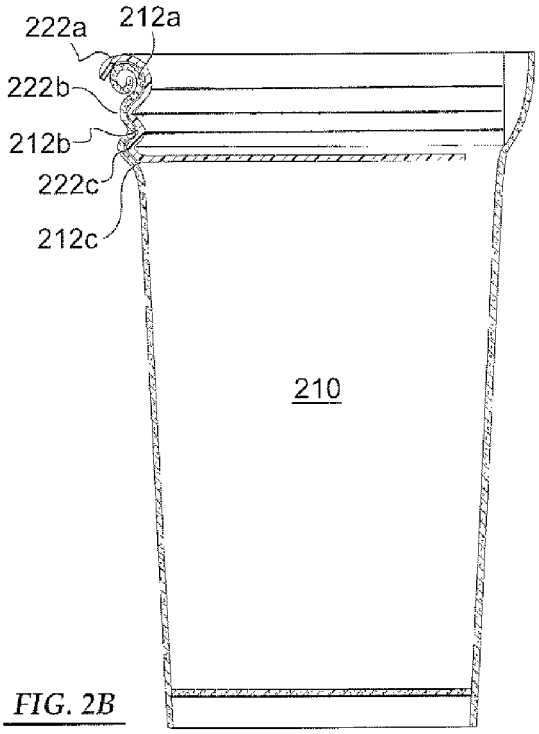
FIG. 2B is a sectional illustration of the second preferred embodiment as viewed along lines 2B of FIG. 2A.
Figure 3A:
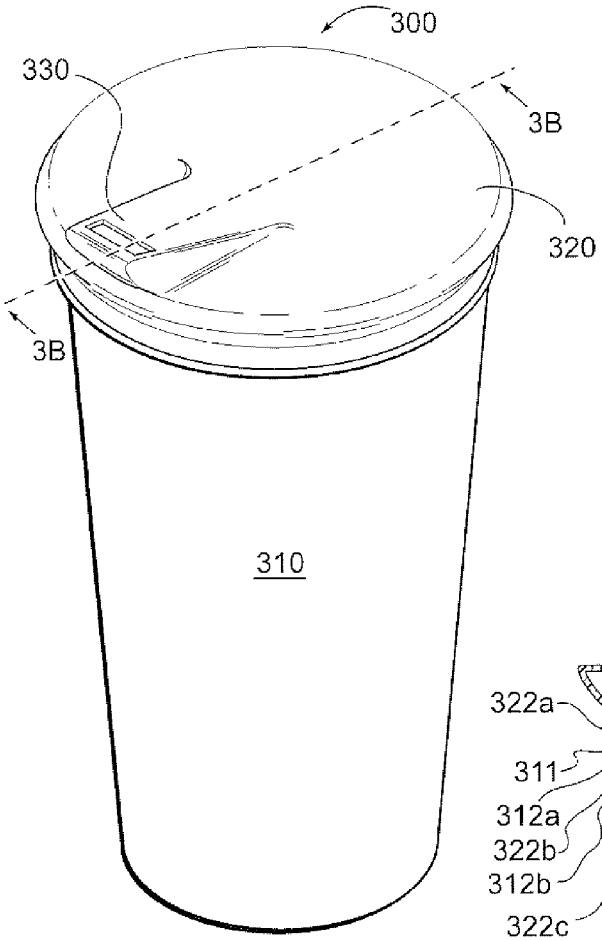
FIG. 3A is a perspective illustration of a third preferred embodiment of the present invention.
Figure 3B:
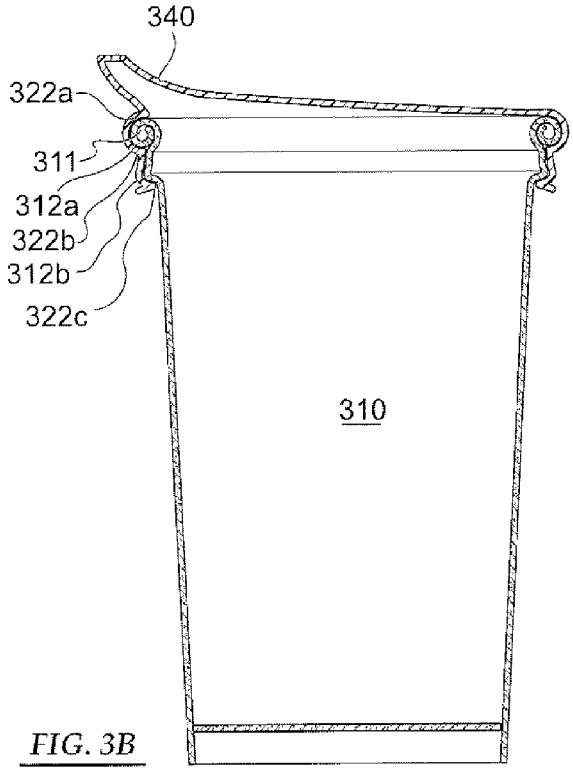
FIG. 3B is a sectional illustration of the third preferred embodiment as viewed along lines 3B of FIG. 3A.
Figure 4A:
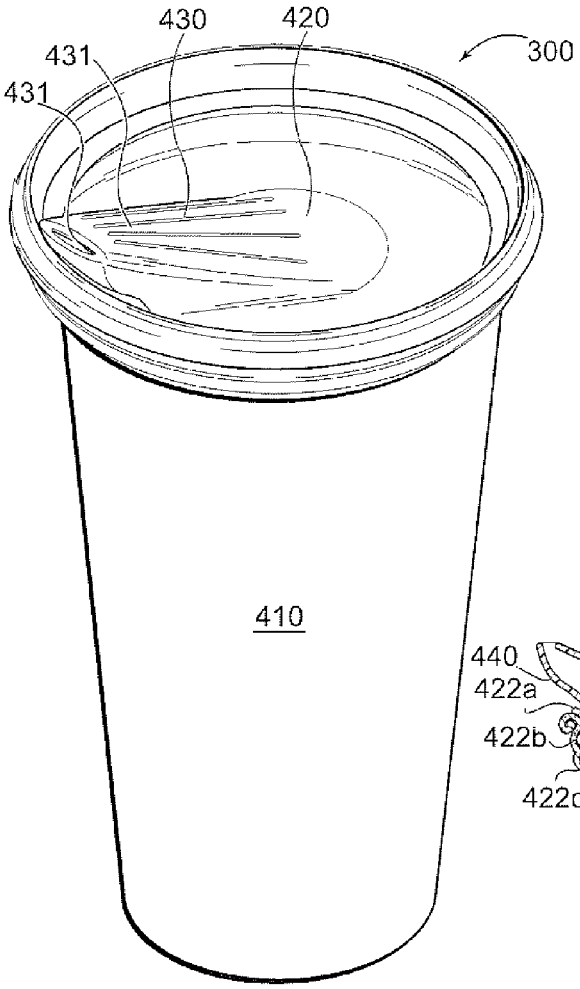
FIG. 4A is a perspective illustration of a fourth preferred embodiment of the present invention.
Figure 4B:
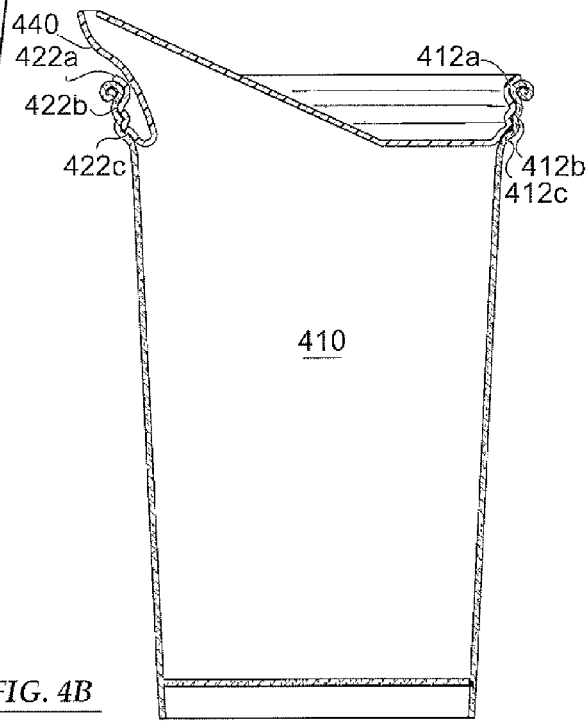
FIG. 4B is a sectional illustration of the fourth preferred embodiment as viewed along lines 4B of FIG. 4A.

Additionally, embodiments 100, 200 with the spout 130, 230 formed from the cup side wall can have the spout angled relative to the vertical axis of the container such that it causes the velocity of the fluid to increase as the fluid enters the spout and flows toward a distal tip 131, 231 as seen in FIG. 1C as well as FIG. 2A. Further, this spout angle reduces the required degree to which the consumer must tilt the container to access the liquid inside. In other embodiments, the lip on the distal end 131, 231 of the spout includes acute angled surfaces which, in conjunction with the increased flow velocity of the fluid through the spout cause the fluid to separate from the cup when pouring.

Further, the container 100, 200, 300, 400 (cup and lid) can be made of any material, such as but not limited to, metal, plastic, paper/cardboard, or any combinations thereof. The cup 110, 210, 310, 410 can also be made from thermally insulating material, designed to protect the consumer from hot liquids in the cup. Instead of using the typical Java- Jacket® to slide over the cup, the cup itself can be constructed from thermally insulating material like corrugated cardboard 110*a* (FIG. 1A) and the like. The majority of the outer side walls of the cup can be composed of the thermally insulating material, providing heat protection over the entire carrying surface of the cup. In another embodiment, the thermally insulating material comprises only the part of the cup that a Java-Jacket® or similar sleeve would typically be placed. This thermally insulating material 110*a* also provides a textured, ergonomic surface such that the consumer has a better grip on the cup.

As stated, in some embodiments 300, 400 the lid 320, 420 can comprise a hollow spout, formed from the lid, rising above the rim of the cup 310, 410 allowing easy access to a human mouth. The spout 330, 430 is designed to direct the flow of liquid out of the cup and into the consumer's mouth, such that the consumer does not have to tilt the cup as far to access the beverage. The spout may be further designed to fit the shape of a human mouth, such that the underside of the spout is flush with the lower lip, preventing spillage from the cup or the mouth. The underside of the spout may have a variety of complementary lower lip shapes.

In some embodiments (FIG. 4A, for example), the hollow spout 430 tapers towards a distal opening 431, such that the spout limits the volume of liquid flowing from the container. The tapered distal opening 431 can have various shapes, such as a wide, flattened hole, or a small circle, or an ellipse. In some embodiments, the tapered distal opening 431 can be placed at various angles with relation to the vertical axis of the container, such that the opening directs the flow of liquid into the consumer's mouth with less chance of spillage. In some embodiments, the spout may be flexible, allowing the consumer to access liquid inside the container from a variety of angles relative to the vertical axis of the container.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed above even when not initially claimed in such combinations.

While the particular Container with Locking Feature as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed is:

1. A container comprising:

a vessel having an open top with a beaded rim and a closed bottom, wherein the vessel is capable of receiving and containing liquid, and further wherein the vessel includes a spout formed from an upper side wall and the beaded rim, further extending outwardly from the vessel; and a removable lid having a lid brim, the lid comprising:

a first outwardly protruding annular ridge configured at a top of the beaded rim when the lid is coupled to the vessel; and a second outwardly protruding annular ridge below the first annular ridge with respect to the beaded rim wherein the lid brim between the first and second annular ridges engages an inner half of the beaded rim leaving an outer half of the beaded rim exposed, and wherein the vessel and lid fit in a locking relationship.

2. The container of claim 1 further comprising a lower most outwardly protruding annular ridge wherein the second annular ridge is configured between the first annular ridge and the lower most annular ridge, the first, second and lower most annular ridges together providing a locking relationship between the vessel and the lid.

3. The container of claim 1, wherein the lid comprises at least two inwardly protruding annular ridges.

4. The container of claim 1, wherein the lid comprises an opening to accommodate the spout, such that when the container is closed, the lid opening allows the spout to fit through and the spout is accessible to a user.

5. A container comprising:

a vessel having an open top with a beaded rim and a closed bottom, wherein the vessel is capable of receiving and containing liquid; and a removable lid having a lid brim, the lid comprising:

a first outwardly protruding annular ridge configured at a top of the beaded rim when the lid is coupled to the vessel;

a second outwardly protruding annular ridge below the first annular ridge with respect to the beaded rim wherein the lid brim between the first and second annular ridge engages an inner half of the beaded rim leaving an outer half of the beaded rim exposed, and wherein the vessel and lid fit in a locking relationship;

a spout; and an opening to accommodate the spout such that when the container is closed, the lid opening allows the spout to fit through and the spout is accessible to a user, and further wherein the spout is formed from an upper side wall and rim, further extending outwardly from the vessel and through the opening.

6. The container of claim 1, wherein the vessel is made from thermally insulating material, the thermal insulating material comprising corrugated cardboard material.

7. The container of claim 1, wherein the vessel is made from textured material, thereby aiding in grasping the container by a user.

8. The container of claim 5, wherein the vessel is made from thermally insulating material, the thermal insulating material comprising corrugated cardboard material.

9. The container of claim 5, wherein the vessel is made from textured material, thereby aiding in grasping the container by a user.

* * * * *